US009506456B2

(12) United States Patent
Sitzler et al.

(10) Patent No.: US 9,506,456 B2
(45) Date of Patent: Nov. 29, 2016

(54) HYDROSTATIC AXIAL PISTON MACHINE AND RETENTION PLATE

(71) Applicant: Robert Bosch GmbH, Stuttgart (DE)

(72) Inventors: Philipp Sitzler, Horb (DE); Stefan Hoppe, Sulz a.N. (DE)

(73) Assignee: Robert Bosch GmbH, Stuttgart (DE)

( * ) Notice: Subject to any disclaimer, the term of this patent is extended or adjusted under 35 U.S.C. 154(b) by 294 days.

(21) Appl. No.: 14/290,242

(22) Filed: May 29, 2014

(65) Prior Publication Data

US 2014/0360352 A1 Dec. 11, 2014

(30) Foreign Application Priority Data

Jun. 5, 2013 (DE) ..... 10 2013 210 416

(51) Int. Cl.

| | |
|---|---|
| ***F04B 1/12*** | (2006.01) |
| ***F04B 1/20*** | (2006.01) |
| ***F04B 27/08*** | (2006.01) |

(52) U.S. Cl.

CPC ..... *F04B 1/126* (2013.01); *F04B 1/2078* (2013.01); *F04B 27/086* (2013.01); *F04B 27/0882* (2013.01); *F04B 27/0886* (2013.01)

(58) Field of Classification Search

CPC .... F04B 1/126; F04B 1/2078; F04B 27/086; F04B 27/0882; F04B 27/0886

USPC ..... 92/57, 71; 91/499

See application file for complete search history.

(56) References Cited

U.S. PATENT DOCUMENTS

| | | | | |
|---|---|---|---|---|
| 4,478,557 A * | 10/1984 | Schott | F01B 3/0035 417/271 |
| 4,516,475 A * | 5/1985 | Fricke | F04B 1/0413 91/488 |
| 5,862,704 A * | 1/1999 | Seljestad | F04B 1/2085 74/60 |
| 6,244,160 B1 * | 6/2001 | Kunze | F01B 3/0041 417/269 |
| 7,546,797 B2 * | 6/2009 | Betz | F04B 1/126 92/57 |
| 7,975,600 B2 * | 7/2011 | Beck | F04B 1/126 92/57 |
| 8,167,580 B2 * | 5/2012 | Stoelzer | F01B 3/0085 417/269 |

FOREIGN PATENT DOCUMENTS

| | | |
|---|---|---|
| DE | 1 453 452 A1 | 9/1969 |
| DE | 2 250 510 A1 | 4/1974 |
| DE | 197 06 263 C1 | 7/1998 |

* cited by examiner

*Primary Examiner* — Thomas E Lazo

(74) *Attorney, Agent, or Firm* — Maginot, Moore & Beck LLP

(57) ABSTRACT

An axial piston machine has a cylinder connected to a shaft and a multiplicity of pistons guided by the cylinder and supported by sliding shoes on a swashplate. Each sliding shoe has a sliding shoe collar and a sliding shoe head, and is held in place in a direction of a contact position by an annular retraction plate. An end face segment of the retraction plate engages an annular surface between the sliding shoe collar and the sliding shoe head, and each sliding shoe collar passes through an associated aperture in the retraction plate and connects to a corresponding piston. A surround is formed in the retraction plates at the head of each sliding shoe, and is configured to fit around an axial segment of a circumference of the sliding shoe head in a direction toward the swashplate.

15 Claims, 3 Drawing Sheets

HYDROSTATIC AXIAL PISTON MACHINE AND RETENTION PLATE

This application claims priority under 35 U.S.C. §119 to patent application no. DE 10 2013 210 416.2, filed on Jun. 5, 2013 in Germany, the disclosure of which is incorporated herein by reference in its entirety.

The disclosure relates to a hydrostatic axial piston machine, and to a retraction plate suitable for an axial piston machine of this kind.

BACKGROUND

The basic construction of an axial piston machine of the type in question is disclosed in DE 197 06 263 C1, for example. An axial piston machine of this kind has a cylinder drum which is connected for conjoint rotation to a shaft and is rotatably mounted in a housing. A multiplicity of pistons is guided in the cylinder drum in such a way as to be movable in the axial direction. Piston feet projecting from the cylinder drum in parallel with the axis are supported by respective sliding shoes on a swashplate, the pivoting angle of which can be adjusted in order to set the delivery/absorption volume. The pistons rest against the swashplate via sliding shoes, which are each connected in the manner of a ball joint to the associated pistons and slide in sliding contact with a sliding surface of the non-rotatable swashplate. The sliding shoes are acted upon in the direction of their position of contact with the swashplate by means of a retraction plate, wherein the retraction plate, for its part, is supported on a retraction ball connected to the drive shaft. The retraction plate has a multiplicity of apertures, each of which is penetrated by a sliding shoe collar of the sliding shoe, with the result that the sliding shoes are guided both in the axial direction and in the radial direction.

German Offenlegungsschrift 2 250 510 and German Patent 1 453 452 show axial piston machines of the above-described construction in which the retraction plate is embodied with an encircling circumferential rim which overlaps a segment of the sliding shoes in the axial direction toward the swashplate. By means of this dish-shaped retraction plate, the sliding shoes are covered with respect to the outside.

However, it has been found that considerable churning losses occur with such a design principle when the cylinder is rotating and the housing is filled with oil owing to the revolving sliding shoes, said losses increasing the required drive torque in pump mode and reducing the output torque in motor mode.

To avoid such problems, attempts have already been made to drain the pressure medium from the pump housing by means of a drainage pump. However, such solutions are relatively complex since corresponding design measures and costs for the additional pump arise. Moreover, functional risks are increased since lubrication of components and shaft sealing are not always guaranteed. Another disadvantage is that the power requirement of the additional pump reduces the efficiency of the axial piston machine, meaning that no significant advantage can be achieved over solutions with a housing that is filled with pressure medium.

SUMMARY

Given this situation, it is the underlying object of the disclosure to increase the efficiency of an axial piston pump with a low outlay on equipment and without significant functional restrictions.

This object is achieved by an axial piston machine. A solution of this kind also includes a retraction plate.

The axial piston machine according to the disclosure has a cylinder which is connected for conjoint rotation to a shaft and in which a multiplicity of pistons is guided, which are supported via sliding shoes on a swashplate. The sliding shoes are held in the direction of the contact position thereof by means of a retraction plate, wherein an end face segment of the retraction plate in each case engages on an annular surface between a sliding shoe collar and a sliding shoe head, wherein the sliding shoe collar passes through an associated aperture in the retraction plate. According to the disclosure, a surround is formed on each of the retraction plates at the head of the sliding shoe, said surround fitting around an axial segment of the circumference of the sliding shoe head in a direction toward the swashplate. These surrounds are designed in such a way that they fit around the sliding shoe in the region between the actual retraction plate and the swashplate and thus cover it with respect to the outside.

In this way, the formation of dynamic pressure fields during the operation of the axial piston machine is prevented in the region of the sliding shoes. These dynamic pressure fields are responsible for a large part of the churning losses explained at the outset, and therefore the efficiency of the axial piston machine is correspondingly improved over conventional solutions. The axial piston machine can be operated with a housing that is filled with pressure medium, with the result that the functional risks are significantly reduced as compared with the above-described solution with a drainage pump.

The retraction plate according to the disclosure is accordingly designed with surrounds on the swashplate side whose axial length is configured in accordance with the sliding shoe heads surrounded by them in the installed condition, thus ensuring that said heads are substantially fully surrounded in the axial direction.

In one illustrative embodiment of the disclosure, the surround extends over more than 50%, preferably more than 90%, of the axial length of the sliding shoe head.

The axial length of this surround is preferably chosen in such a way that a slight gap remains between the front face of the swashplate and the annular end face of the surround, this gap being of secondary importance for the occurrence of churning losses.

The churning losses can be further reduced if in each case a cover is also provided in the direction of the associated piston, said cover then correspondingly fitting around the sliding shoe collar to the greatest possible extent in the axial direction.

In an embodiment the axial length of this cover on the piston side is configured in accordance with the maximum pivoting angle of the swashplate, thus ensuring that the pivoting angle is not reduced by the cover.

In an embodiment which is particularly easy to produce, the surrounds are formed on a covering ring, which is connected to a base plate of the retraction plate.

The relative positioning of the covering ring and of the base plate is particularly simple if a shoulder of the covering ring fits around said base plate.

The connection between the covering ring and the base plate can be accomplished by screwing, pressing or latching or the like.

In the case in which the covering ring is screwed to the base plate, the screws can be located alternately in parallel with the axis, wherein said screws are designed so as to be sunk into the end face on the swashplate side and can project on the rear side, i.e. on the piston side.

In one embodiment of the disclosure, it is envisaged that the covering ring should be made of plastic. In principle, it is also possible to mold the covering ring onto the retraction plate by injection molding.

In an embodiment, the covering ring is of multipart design.

In an embodiment the covering ring is of somewhat wider design in the radial direction than the base plate.

A very compact solution is obtained if the surrounds lie on the same pitch circle as the apertures in the retraction plate and overlap one another.

A number of embodiments of an axial piston machine according to the disclosure and of a retraction plate according to the disclosure are explained in greater detail below by means of drawings.

DETAILED DESCRIPTION

Figure 1:
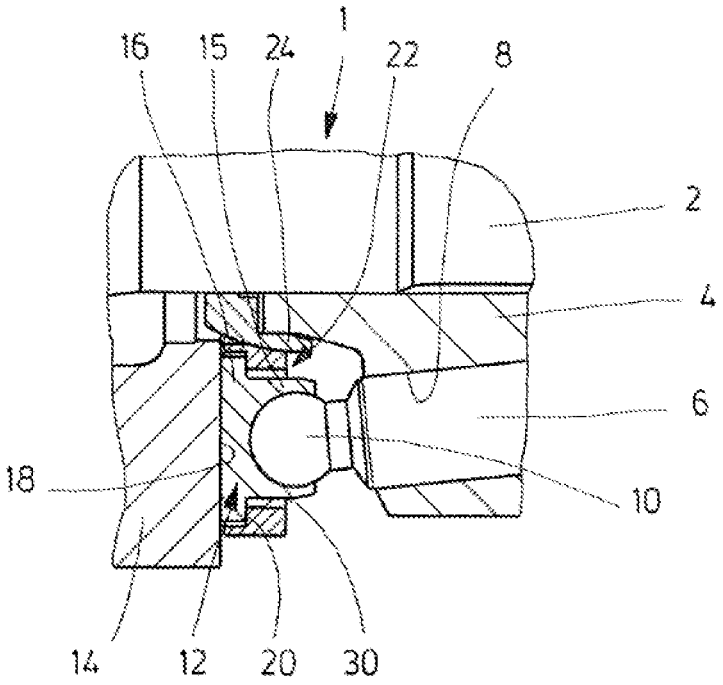
FIG. 1 shows a partial view of a first illustrative embodiment of an axial piston machine according to the disclosure.

The basic construction of axial piston machines is known from the initially explained prior art, e.g. DE 197 06 263 C1, and therefore only those constructional elements that are required for an understanding of the disclosure are explained below.

An axial piston machine 1 according to the disclosure has a shaft 2, which is mounted in a housing (not shown) and is connected for conjoint rotation to a cylinder 4 of a drive mechanism. Guided in this cylinder in a manner which allows axial movement is a multiplicity of pistons 6, each of which delimits a working chamber (not shown) with a cylinder bore 8 of the cylinder 4. A piston foot 10, remote from the working chamber, of each piston 6 is supported via a sliding shoe 12 on a swashplate 14, which is preferably mounted in a pivotable manner in the housing, making it possible to set the delivery/absorption volume of the axial piston machine 1 by pivoting this swashplate.

The connection between the sliding shoe 12 and the piston front 10 is embodied in the manner of a ball joint, wherein the piston foot 10 is designed as a spherical segment which engages positively in a socket of a sliding shoe collar 15. Adjoining this sliding shoe collar 15, the sliding shoe 12 has a sliding shoe head 16, which rests against a sliding surface 18 of the swashplate 14. For hydrostatic relief, pockets can be formed on the sliding shoe head 16 and these can be subjected to high pressure in order to bring about adequate lubrication and pressure relief of the sliding shoe.

According to the illustration in FIG. 1, the sliding shoe head 16 has a larger diameter than the sliding shoe collar 15, with the result that an annular surface 20 is formed. The multiplicity of sliding shoes 12 is acted upon in the direction of the swashplate 14 by means of a retraction plates 22, with the result that sliding contact between the sliding shoes 12 and the swashplate 14 is ensured even when low pressure is acting in the working space of the respective piston. According to the illustration in FIG. 1, the retraction plate 22 rests against the annular surfaces 20 of the sliding shoes 12. In this case, the retraction plate 22 is acted upon in the direction of its contact surface by means of a retraction ball 24 connected for conjoint rotation to the shaft 2 and the cylinder 4. This retraction ball 24 is penetrated by the drive shaft 2 and has a spherical contact surface which engages on a correspondingly designed inner circumferential surface 26 of the retraction plate 22.

Figure 4:
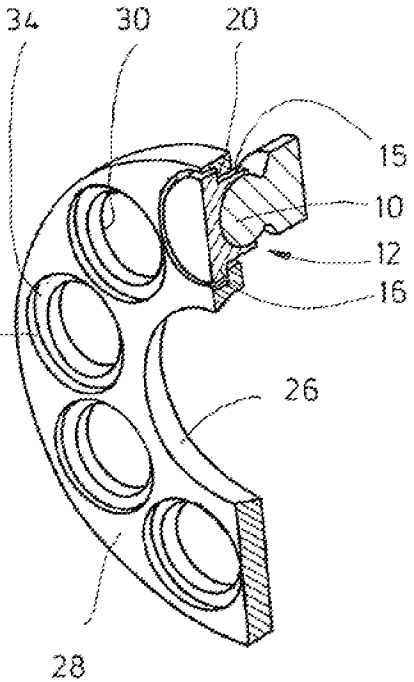
FIG. 4 shows a three-dimensional representation of the section shown in FIG. 3.
Figure 2:
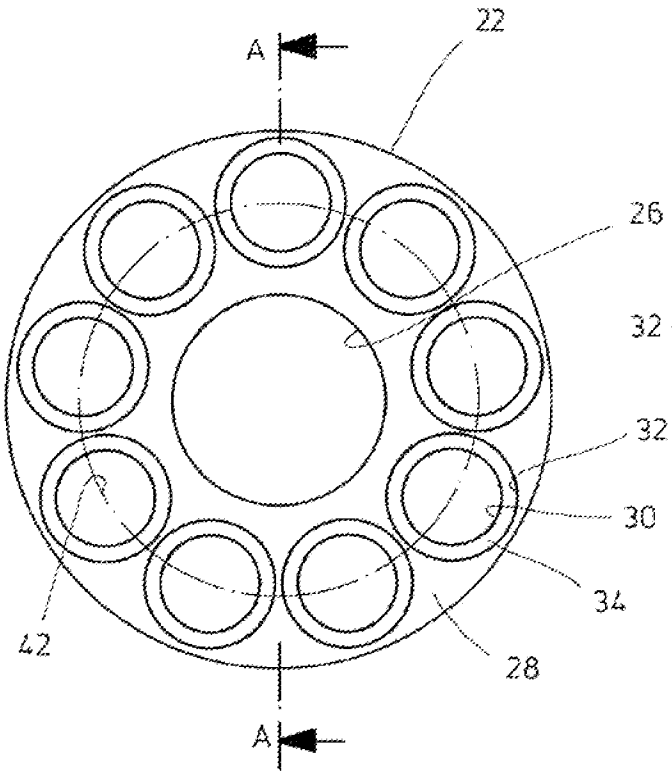
FIG. 2 shows a plan view of a retraction plate of the axial piston machine shown in FIG. 1.
Figure 3:
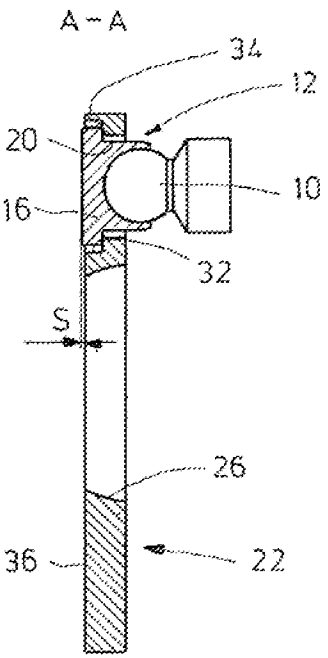
FIG. 3 shows a section along the line A-A in FIG. 2.

FIGS. 2, 3 and 4 show different illustrations of a retraction plate 22, wherein a sliding shoe 12 and a piston foot 10 are also illustrated in FIGS. 3 and 4. In the plan view according to FIG. 2, it is possible to see the annular construction of the retraction plate 22 with the inner circumferential surface 26 designed to match the outer contour of the retraction ball 24 and fitting around the shaft 2. A multiplicity of apertures 30, each of which is penetrated by the sliding shoe collar 15 according to the sectional illustration in FIG. 1, opens into the annular end face 28.

On the swashplate side, each aperture 30 is widened in the radial direction, with the result that the circumferential wall of enlarged diameter forms a surround 32, the diameter of which is greater than the diameter of the aperture. An annular shoulder 34, along which the retraction plate 22 rests against the end face 20 of the respective sliding shoe 12, is thereby formed between the aperture and the surround 32.

As is apparent particularly from the illustration according to FIG. 3, the sliding shoe head 16 enters almost completely into the region around which the surround 32 fits, with the result that said surround fits around the sliding shoe head 16 with the exception of the axial section S. Accordingly, a gap, the gap dimension of which corresponds to the dimension S, remains between the sliding surface 36 of the retraction plate 22 on the swashplate side and the sliding surface 18 of the swashplate 14. In other words, the sliding shoes 12, in particular the sliding shoe heads 15 thereof, are almost completely surrounded and covered in the radial direction by the surround 32, with the result that, when the drive mechanism rotates in the oil-filled housing, the churning losses explained at the outset are significantly reduced as compared with conventional solutions. At the same time, however, according to FIGS. 3 and 4 the retraction plate 22 rests substantially only along its annular shoulders 34 against the annular surfaces 20 of the sliding shoes 12, while the circumferential walls of the aperture 30 and of the surround 32 are arranged at a radial distance from the corresponding outer circumferential sections of the sliding shoes 12 since the diameter of the surrounds 32 is made larger than the outside diameter of the sliding shoe head 16 and the diameter of the aperture 30 is made larger than the outside diameter of the sliding shoe collar 15.

According to the illustration in FIG. 2, all the surrounds 32 and apertures 30 lie on a common pitch circle 42, wherein the pitch and the diameter of the surrounds 32 are chosen in such a way that the circumferential segments do not overlap one another.

Figure 5:
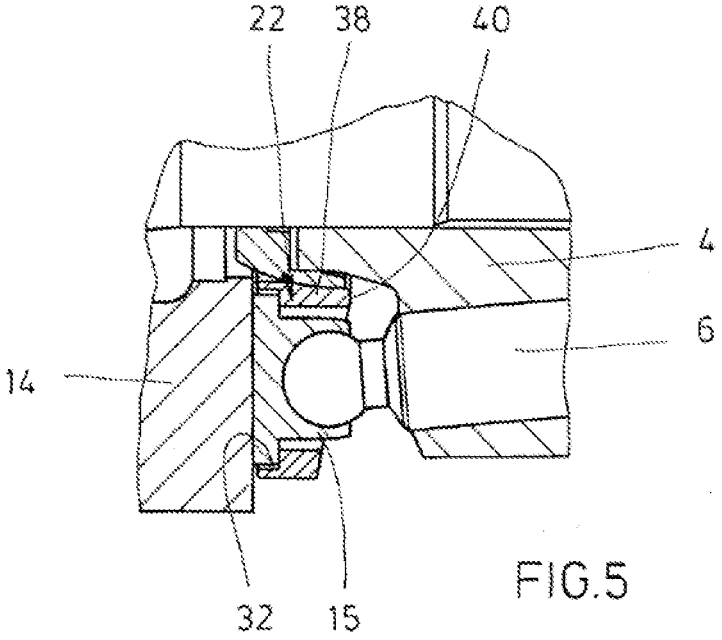
FIG. 5 shows another illustrative embodiment of a retraction plate of an axial piston machine.

The churning losses can be further minimized if the retraction plate shown in FIG. 5 is designed in such a way that it also almost completely surrounds the sliding shoe collar 15. For this purpose, the retraction plate 22 is extended in the axial direction toward the piston 6 or the drum 4 is extended toward a cover 38 which covers almost the entire axial length of the sliding shoe collar 15 in the radially inward direction. Radially outward (at the bottom in FIG. 5), the cover 38 is shortened somewhat in the axial direction. As indicated in chain-dotted lines in FIG. 5, an end face 40 of said cover 38 is angled obliquely to the radial direction. This oblique angle is required in order to avoid restricting the pivoting angle of the swashplate 14. In this illustrative embodiment, this cover 38, which can be designed as a sleeve-shaped projection on the rear side of the retraction plate, for example, is of one-piece design with the retraction plate 22. Instead of sleeve-type projections of this kind, the retraction plate 22 can also be embodied with a greater axial length, resulting in the profile illustrated in FIG. 5, wherein the surrounds 32 are also formed, with the result that the axial wall thickness of the retraction plate is significantly greater than is the case in the prior art.

Figure 7:
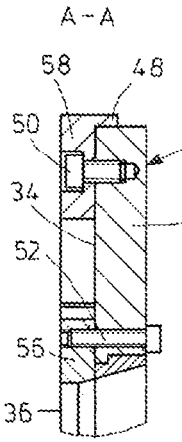
FIG. 7 shows a section along the line A-A in FIG. 6.
Figure 6:
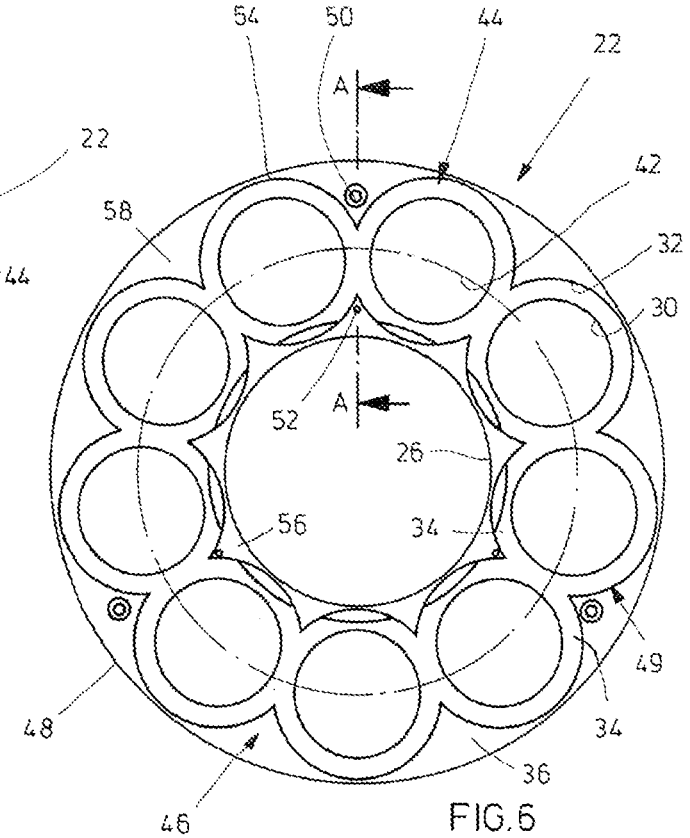
FIG. 6 shows a plan view of a third illustrative embodiment of a retraction plate.

FIGS. 6 and 7 show a development of the illustrative embodiment shown in FIGS. 1 to 4. In the last-mentioned illustrative embodiment, the retraction plate 22 is of one-piece design. FIGS. 6 and 7 show a version in which the retraction plate 22 is manufactured in several parts.

FIG. 6, in turn, shows a plan view corresponding to FIG. 2 of the illustrative embodiment of the retraction plate 22, wherein in this illustrative embodiment the diameter of the pitch circle 42 and the diameter of the surrounds 32 are chosen in such a way that the circumferential segments intersect. Here, the apertures 30 are formed on a base plate 44 of the retraction plate 22, wherein the inner circumferential surface 26 is also formed substantially in this base plate 44. The base plate 44 has placed against the front face thereof a two-part covering ring 46, in which the surrounds 32 are formed. Owing to the overlap between these surrounds 32, this covering ring 46 according to the illustration in FIG. 6 is embodied with an encircling surround structure 49. The covering ring 46 is of two-part design with an inner ring 56 and an outer ring 58. These two rings 56, 58 are screwed to the base plate 44. The inner circumferential edges of the outer ring 58 and the outer circumferential edges of the inner ring 56 are designed to resemble internal and external gears, and they thus jointly form the surrounds 32 having the surround structure 49. The inner circumferential surface of the inner ring 56 extends flush with the inner circumferential surface of the base plate 44.

As in the illustrative embodiment described above, each surround 32 is formed coaxially with the respective associated aperture 30, with the result that the associated annular shoulders 34 are formed by a front face segment of the base plate 44.

According to the illustration in FIG. 7, which shows a section along the line A-A in FIG. 6, the outer ring 58 is formed with a circumferential shoulder 48, which fits flush around part of the outer circumference of the base plate 44, ensuring that the latter is centered with respect to the outer ring 58. The inner ring 56 and the outer ring 58 are fixed axially by means of a multiplicity of screws 50, 52. The outer ring 58 is fixed by means of the screws 50, which are screwed in from the direction of the swashplate 14, while the inner ring 56 is fixed by means of the screws 52, which are screwed in from the opposite side. As explained above, the retraction plate 22 slides by means of its sliding surface 36 on the swashplate 14. Since this sliding surface 36 is formed by the outer end face of the covering ring 46, the screws 50 must accordingly also be sunk into the covering ring 46. The screw heads of the screws 52 arranged on the rear side do not have to be sunk. At the same time, it is preferred if the screws 50, 52 are screwed into the gusset-shaped areas between adjacent surrounds 32.

In the illustrative embodiment shown in FIGS. 6 and 7, the outer circumferences of the base plate 44 and the covering ring 46 are made as small as possible. This can be seen from the fact that circumferential segments 54 of the base plate 44 can be seen through the surrounds 32 in the illustration according to FIG. 6. In this case, the ring width of the covering ring 46 is made greater than that of the base plate 44.

Figure 8:
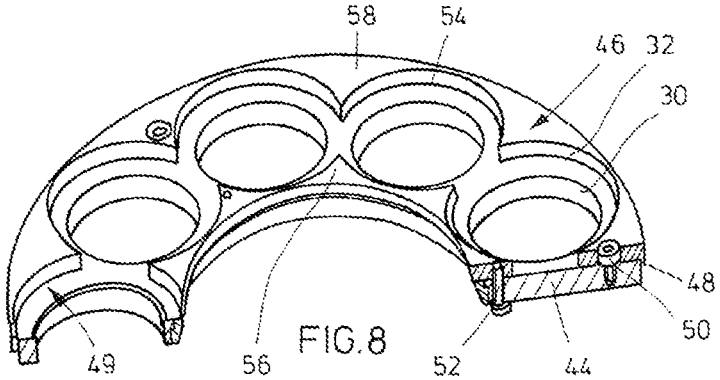
FIG. 8 shows a three-dimensional sectional representation of another illustrative embodiment of a retraction plate.

FIG. 8 shows a three-dimensional sectional representation of the illustrative embodiment shown in FIGS. 6 and 7. It is very clear from this illustration that the inner circumferential edges of the outer ring 58 and the outer circumferential edges of the inner ring 56 form the surrounds 32.

As an alternative, the covering ring 46 can also be embodied as a single part, in which case it must be ensured that the circumferential edges of the surrounds 32 do not overlap as in the illustrative embodiment described above, resulting in a plan view which approximates to that in the illustrative embodiment shown in FIG. 2.

A disclosure is made of an axial piston machine and of a retraction plate for an axial piston machine of this kind. The latter is designed in such a way that it fits around sliding shoes of the axial piston machine in the axial direction in order to avoid churning losses.

What is claimed is:

1. A hydrostatic axial piston machine, comprising:

a cylinder connected to a shaft such that the cylinder conjointly rotates with the shaft; and a multiplicity of pistons guided in the cylinder and supported via sliding shoes on a swashplate, wherein:

each of the sliding shoes includes a sliding shoe collar and a sliding shoe head, and is held in a direction of a contact position by an annular retraction plate;

an end face segment of the annular retraction plate engages an annular surface between the sliding shoe collar and the sliding shoe head of each of the sliding shoes;

the sliding shoe collar of each of the sliding shoes passes through an associated aperture in the annular retraction plate and connects to a corresponding one of the multiplicity of pistons;

a surround is formed at each aperture of the annular retraction plate; and each surround fits around an axial segment of a circumference of the sliding shoe head of a corresponding one of the sliding shoes in a direction toward the swashplate.

2. The hydrostatic axial piston machine according to claim 1, wherein each surround extends around more than 50% of an axial length of the sliding shoe head of a corresponding one of the sliding shoes.

3. The hydrostatic axial piston machine according to claim 1, wherein a gap is located between an end face segment of each surround and a sliding surface of the swashplate.

4. The hydrostatic axial piston machine according to claim 1, wherein the annular retraction plate includes a cover on a piston side that extends toward the multiplicity of pistons.

5. The hydrostatic axial piston machine according to claim 4, wherein an axial length of the cover that extends toward the multiplicity of pistons is oriented in accordance with a pivoting angle of the swashplate.

6. The hydrostatic axial piston machine according to claim 1, wherein:

each surround is formed on a covering ring; and the covering ring is connected to a base plate of the annular retraction plate.

7. The hydrostatic axial piston machine according to claim 6, wherein the covering ring includes a circumferential shoulder configured to fit around an outer circumference of the base plate of the annular retraction plate.

8. The hydrostatic axial piston machine according to claim 6, wherein the covering ring is screwed, pressed, or latched to the base plate.

9. The hydrostatic axial piston machine according to claim 8, wherein:

the covering ring is screwed to the base plate with screws; and the screws are alternately screwed in parallel to an axial axis such that the screws are sunk into the covering ring on a swashplate side and project on a rear side of the base plate.

10. The hydrostatic axial piston machine according claim 6, wherein the covering ring is formed from plastic.

11. The hydrostatic axial piston machine according to claim 6, wherein the covering ring is molded by injection molding.

12. The hydrostatic axial piston machine according to claim 6, wherein the covering ring is a multipart covering ring.

13. The hydrostatic axial piston machine according claim 6, wherein, in a radial direction, the covering ring is wider than the base plate of the annular retraction plate.

14. The hydrostatic axial piston machine according to claim 1, wherein each surround is positioned on a pitch circle and each surround overlaps another surround.

15. An annular retraction plate for an axial piston machine, comprising:

a multiplicity of apertures, wherein:

each aperture is configured to receive a sliding shoe collar;

surrounds are formed coaxially with the apertures on a swashplate side of an annular retraction plate; and each surround is configured to fit around an axial length of a sliding shoe head in an installed condition.

* * * * *